US006888321B2

(12) United States Patent
Arimoto et al.

(10) Patent No.: US 6,888,321 B2
(45) Date of Patent: May 3, 2005

(54) DEVICE FOR OPERATING A HIGH PRESSURE DISCHARGE LAMP

(75) Inventors: Tomoyoshi Arimoto, Tatuno (JP); Yoshikazu Suzuki, Yokohama (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/601,555

(22) Filed: Jun. 24, 2003

(65) Prior Publication Data

US 2004/0004448 A1 Jan. 8, 2004

(30) Foreign Application Priority Data

Jul. 2, 2002 (JP) ..... 2002-193502

(51) Int. Cl.[7] ..... H05B 37/00

(52) U.S. Cl. ..... 315/289; 315/209 R; 315/307; 315/360; 315/291; 315/DIG. 5; 315/DIG. 7

(58) Field of Search ..... 315/289, 290, 315/247, 209 R, 291, 307, 360, 276, 287, 246, DIG. 5, DIG. 7

(56) References Cited

U.S. PATENT DOCUMENTS 4,398,123 A * 8/1983 Tsuchihashi et al. ..... 315/46
5,932,976 A 8/1999 Maheshwari et al.
6,020,691 A 2/2000 Sun et al.
6,049,179 A 4/2000 Kisaichi et al.
6,661,184 B2 * 12/2003 Okamoto et al. ..... 315/289
6,674,249 B1 * 1/2004 Leskovec ..... 315/289
2002/0047621 A1 4/2002 Van Den Nieuwenhuizen et al.

FOREIGN PATENT DOCUMENTS

JP 06-65175 B2 8/1994

OTHER PUBLICATIONS

European Search Report Dated Sep. 29, 2003.

* cited by examiner

*Primary Examiner*—Haissa Philogene
(74) *Attorney, Agent, or Firm*—Nixon Peabody LLP; David S. Safran

(57) ABSTRACT

A device which improves the starting of a high pressure discharge lamp containing a large amount of mercury, in which the amount of mercury adhering to the lamp electrodes is not the same, by shortening the formation time of the glow discharge in order to reduce the sputtering of the electrodes to a minimum. When the discharge lamp starts, an AC voltage with rectangular waves produced by the full bridge circuit is applied to the discharge lamp. Next, a high voltage pulse is superimposed and applied by an igniter device; the pulse is synchronized to the polarity of the above described AC voltage with rectangular waves. As a result, an alternating current discharge is started in the discharge lamp. Then, the ON/OFF state of the switching devices in the full bridge circuit is fixed and a direct current voltage is applied to the lamp. After a pre-selected time has expired after the transition into direct current operation, the full bridge circuit is operated such that rectangular alternating current waves form. The AC voltage with rectangular waves is then applied to the discharge lamp and a transition into steady-state operation is carried out.

3 Claims, 6 Drawing Sheets

DEVICE FOR OPERATING A HIGH PRESSURE DISCHARGE LAMP

BACKGROUND OF THE INVENTION

1. Field of the Invention

The invention relates to a device for operating a high pressure discharge lamp. The invention relates especially to a device for operating a high pressure discharge lamp which is suited for use for a light source of a projector of the projection type or the like.

2. Description of the Related Art

In a device for operating a discharge lamp, it is known to employ a circuit having a full bridge system of a low frequency of 50/60 Hz in which a high frequency of roughly 20 kHz is superimposed and operation with an alternating high frequency achieved (for example, Japanese patent disclosure HEI 6-65175).

The process of starting the known discharge lamp is as follows. Beginning in the no-load state an igniter circuit superimposes a high voltage pulse which starts a discharge lamp. Thereafter, from the current supply of the feed device of the discharge space the lamp passes from a glow discharge state into an arc discharge state to achieve a steady operating state.

The above described transition from the glow discharge state into the arc discharge state is often a so-called half wave discharge and which does not always takes place advantageously. In the above described discharge lamp of Japanese patent disclosure HEI 6-65175, in order to eliminate this disadvantage, for the duration of the transition from the glow discharge state into an arc discharge state a DC voltage or an AC voltage with a frequency which is lower than in steady-state operation is applied to the discharge lamp.

In either the situation that, at the beginning of starting, a polarity inversion of the current is not carried out, or that at the frequency at which the discharge at the beginning of starting increases sufficiently and at which the re-ignition voltage becomes low enough, an attempt is made to carry out a polarity inversion in order to accomplish advantageous starting efficiency. This is because the so-called re-ignition voltage is formed and because lamp extinction or flickering occurs when it does not proceed as far as to lamp extinction if during the glow discharge, at the beginning of starting, the polarity of the current flowing in the discharge lamp is inverted.

On the other hand, recently a high pressure discharge lamp filled with a large amount of mercury has been considered a light source of a projector device of the projection type or the like. Specifically the amount of mercury added is at least 0.15 mg/mm$^3$ and the vapor pressure during operation is greater than or equal to 150 atm, even if it also depends on the temperature condition and the like. This discharge lamp emits light in the visible range by increasing the mercury vapor pressure, especially continuous spectrum light with an increased red portion. This discharge lamp has good color rendering and high light intensity.

The above described high pressure discharge lamp with greater than or equal to 0.15 mg/mm$^3$ mercury added is repeatedly turned on and off according to the use of a projector device. In the above described high pressure discharge lamp, the mercury during operation is present as vapor, and when turned off, as liquid. The liquid mercury normally adheres to the electrodes with the lowest temperature. The electrodes consist of a metal such as tungsten or the like. Therefore the temperature decreases rapidly. The mercury adhering to the two electrodes is however not the same depending on the cooling state, the variance of the electrode positions and the like, but normally it adheres to one of the electrodes in a large amount.

The reason for this is the following. Due to the deviation in the positional relationship of the two electrodes to each another during the fabrication of the lamp, due to the positional relationship of the lamp to the reflector in the case of using a lamp installed in a reflector, or based on the cooling conditions and the like, a difference arises in the question of during which interval, after the lamp is turned off, does the cooling the temperatures of the two electrodes drop almost to room temperature.

If, during the glow discharge, at the beginning of the starting of the discharge lamp, a DC voltage is applied by the feed device to the above described high pressure discharge lamp as is described in Japanese patent disclosure document HEI 6-65175, a rapid transition takes place from the glow discharge state into the arc discharge state when the electrode on the side on which a large amount of mercury adheres is the cathode. However, in the reverse case, the transition to the arc discharge does not take place quickly. There are also situations in which a glow discharge arises over ten and a few ms. The glow discharge which exists over an interval of this length sputters the electrode material, causes blackening of the inside of the discharge vessel and causes a reduction of the light flux of the lamp.

SUMMARY OF THE INVENTION

The current invention eliminates the above described disadvantages. A primary object of the present invention is to construct a device for operating a high pressure discharge lamp in which the starting of the lamp is improved, in which the formation time of the glow discharge can be shortened, in which by reducing the electrode sputtering to a minimum the light flux maintenance characteristic can be improved and which is suitable for use for a projector device of the projection type or the like.

The object is achieved in accordance with the invention as follows:

(1) After applying a high voltage pulse until the glow discharge, not a DC voltage, but an AC voltage is applied with a frequency which is equal to or is higher than the frequency of the AC voltage applied during steady-state operation. After the transition into the arc discharge a DC voltage is applied, and thereafter an AC voltage is applied in steady-state operation.

By the above described technique, in a glow discharge an AC voltage is applied with a frequency which is equal to or higher than the frequency of the AC voltage which is applied in steady-state operation, then lamp extinction occurs when a glow discharge forms with the next polarity inversion, even if the discharge begins during cathode operation of the electrode with a small amount of adhesion of mercury and a glow discharge forms. This glow discharge therefore lasts only a half period.

Since, at the same time with the polarity inversion, the electrode to which a large amount of mercury is adhering becomes the cathode, after re-ignition a rapid transition into an arc discharge takes place. Since direct current flows with the polarity thereof in the lamp, the arc discharge continues.

Furthermore, since after continuation of operation using a direct current for a given time, e.g., a few seconds, the temperature of the two electrodes is increased enough, neither a glow discharge forms nor does the lamp extinguish in the transition into operation using an alternating current. If, for example, a AC voltage of 300 Hz is applied and the starting process is initiated, the glow discharge is only short, specifically a half period, i.e., 1.7 ms, even if a glow discharge forms. Blackening of the discharge vessel is relatively low.

If the polarity of the DC voltage is made the polarity in the transition into the arc discharge when a DC voltage is applied after the transition of the state of the discharge lamp into an arc discharge, the arc discharge state can be maintained more reliably.

(2) In (1) above, the frequency of the AC voltage which is supplied in the above described glow discharge is fixed higher than that of the AC voltage which is supplied during steady-state operation.

In this way, the length of the glow discharge can be shortened, even if during cathode operation of the electrode having a small amount of adhering mercury the discharge is started and even if in this way a glow discharge forms. Thus, the formation time of the glow discharge can be shortened even more.

(3) In (1) and (2), the high voltage pulse for starting the discharge lamp is operated only at a certain polarity of the AC voltage.

There are situations, for example depending on the positional relationship of the lamp to the reflector, the cooling condition and the like, the electrode to which a large amount of mercury is adhering during the cooling process of the lamp almost to room temperature after the lamp is turned off, which are always the same as the case of using a lamp installed in a reflector or similar cases.

In such a situation, the lamp can be started in a short time when the high voltage pulse is operated only at a certain polarity of the AC voltage, as was described above, i.e., only when the polarity of the AC voltage during starting of the electrode, with a large amount of adhering mercury, is negative is the high voltage pulse for starting produced. In this way, the lamp can be started without a glow discharge forming.

BRIEF DESCRIPTION OF THE DRAWINGS

The invention is further described below for one embodiment shown in the drawings.

DETAILED DESCRIPTION OF THE INVENTION

Figure 1:
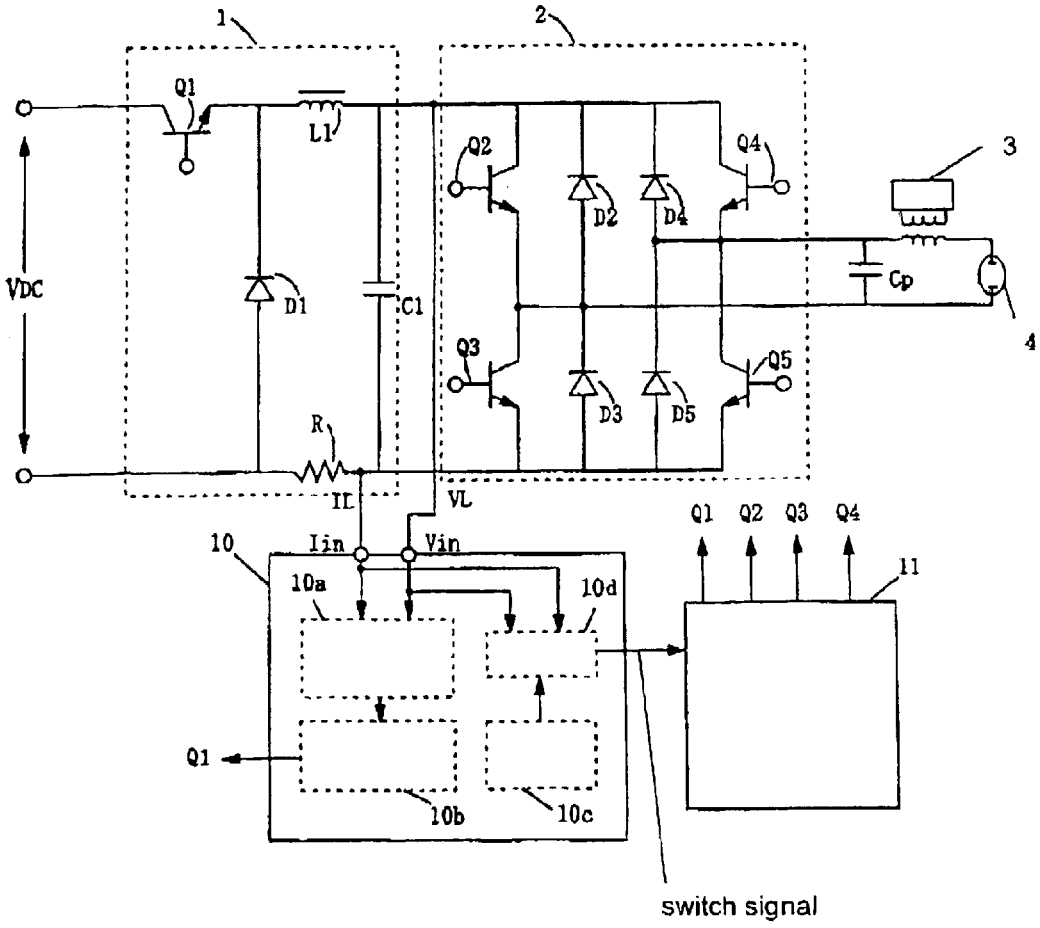
FIG. 1 shows a schematic of the arrangement of one embodiment of a device of the invention for operation of a discharge lamp.

FIG. 1 is a schematic of one embodiment of a device of the invention for operating a high pressure discharge lamp. FIG. 1 shows the arrangement of a lighting circuit using a full bridge circuit. However, a half bridge circuit or a push-pull circuit can also be used.

As is shown in FIG. 1, the circuit in this embodiment is connected to a voltage reduction chopper circuit 1 which is supplied with a DC voltage, and also to the output side of the voltage reduction chopper circuit 1; it comprises a full bridge circuit 2 which converts the DC voltage into a voltage with rectangular waves, and of an igniter device 3 which when the lamp is started produces a high voltage pulse. An AC voltage with rectangular waves or a DC voltage which is output by the full bridge circuit 2 is applied to the discharge lamp 4. A bypass capacitor Cp is connected parallel to the output side of the full bridge circuit 2 and bridges the high voltage pulse which is produced by the igniter device 3.

Furthermore, there are a control circuit 10 for controlling the voltage reduction chopper circuit 1 and the igniter device 3, and a full bridge driver circuit 11 for driving the full bridge circuit 2.

In the above described discharge lamp 4, as was described above, a silica glass discharge lamp is filled with at least 0.15 mg/mm$^3$ mercury. The discharge lamp 4 is, for example, an ultra-high pressure discharge lamp of the short arc type in which a pair of electrodes is located opposite. For example, the discharge lamp described below can be used:

Inside volume of the arc tube: 100 mm$^3$

Distance between the electrodes: 1.0 mm

Amount of mercury added: 0.25 mg/mm$^3$

Rare gas: add 100 Torr argon

The operating conditions of the above described discharge lamp are:

Lamp wattage: in the range from 60 W to 400 W, for example 200 W

Lamp current: in the range from 0.6 A to 7.0 A, for example 2.8 A

Lamp voltage: in the range from 60 V to 130 V, for example 70 V.

The voltage reduction chopper circuit 1 includes a switching device Q1 which carries out switching controlled by the output of the control circuit 10, a diode D1, an inductance L1, and a capacitor C1. The output voltage $V_L$ of the voltage reduction chopper circuit and the output current $I_L$ which is determined by the determination resistor R are supplied to the terminal Vin for determination of the voltage and the terminal Iin for determining the current of the control circuit 10. Based on the voltage $V_L$ and output current $I_L$, the control circuit 10 controls the ON/OFF ratio of the switching device Q1 and, via the full bridge circuit 2, controls the current or the wattage which is supplied to the discharge lamp 4.

The control circuit 10 has a power controller 10*a*, a current limiter part 10*b*, a timer 10*c* and an evaluation part 10*d* which outputs a changeover signal to the full bridge driver circuit. If, during starting of the discharge lamp 4, a transition to an arc discharge takes place, the current supplied to the discharge lamp 4 is limited by the current limiter part 10*b* to a constant value. If, after starting the arc discharge, a transition to steady-state operation takes place, and if the value of the voltage supplied to the discharge lamp 4 is increased, from there on in the power controller 10*a*, as a result of the above described voltage V and the above described current I, the wattage supplied to the discharge lamp 4 is determined, and control is exercised in such a way that the wattage supplied to the discharge lamp reaches the desired value.

The full bridge circuit 2 includes the switching devices Q2 to Q5 which are connected in the manner of a bridge, and which are composed of transistors, such as FETs or the like, and of diodes D2 to D5 which are connected anti-parallel to these switching devices Q2 to Q5.

The full bridge driver circuit 11, based on the changeover signal given by the evaluation part 10*d* of the control circuit 10, drives the switching devices Q2 to Q5, and the discharge lamp 4, when starting, carries an AC voltage with rectangular waves, after the transition from the glow discharge into the arc discharge, carries a DC voltage, and in the steady operating state, carries an AC voltage with rectangular waves.

The operation of the device for operating a discharge lamp in this embodiment is described below.

When the discharge lamp 4 is started, an AC voltage with a rectangular waveform of a few 10 Hz to a few hundred Hz is output by the full bridge circuit 2 first to the lamp. The evaluation part 10*d* of the control circuit 10, when the discharge lamp starts, sets the above described changeover signal to the first AC output signal. In this way, the full bridge driver circuit 11 alternatingly turns on the switching devices Q2, Q5 and the switching devices Q4 and Q5 such that the full bridge circuit 2 produces rectangular alternating waves with the above described frequency. Thus, an AC voltage with rectangular waves is applied to the discharge lamp 4.

The control circuit 10 outputs a signal to an igniter device 3 which is synchronized to the polarity of the above described AC voltage. An igniter voltage, from the igniter device 3, at the above described polarity of the AC voltage superimposes a high voltage pulse on the AC voltage with rectangular waves and applies it.

In this way, a glow discharge forms and the discharge lamp starts an alternating discharge. The duration of the above described glow discharge is 10 microseconds to 1 second (for example, roughly 2.5 ms).

If the state of the discharge lamp 4 passes into an arc discharge, the lamp voltage decreases. If the voltage applied to the terminal Vin for determining the voltage of the control circuit 10 falls below a given voltage, for example, 50 V, the evaluation part 10*d* of the control circuit 10 changes the changeover signal which is output to the full bridge driver circuit 11 into a DC output signal.

In this way, the full bridge driver circuit 11 keeps the switching devices Q2 and Q5 or the switching devices Q4 and Q3 in the ON state so that the full bridge circuit 2 produces a DC output. In this way the a DC voltage is supplied to the discharge lamp 4.

If, in the supply of the direct current to the discharge lamp 4, the polarity of the DC voltage is made the polarity in the transition into the arc discharge, the arc discharge state can be maintained more reliably.

Afterwards, the evaluation part 10*d* of the control circuit 10 changes the above described changeover signal into a second AC output signal. In this way, the full bridge driver circuit 11 triggers the switching devices Q2 to Q5 such that the full bridge circuit 2 produces an AC output.

The changeover into the above described AC output signal takes place by the timer 10*c* which is located in the control circuit 10. The timer 10*c* of the control circuit 10 starts timing when a DC voltage is applied to the discharge lamp 4. If a preset time, for example roughly 3 seconds, passes, the above described changeover signal is changed into a second AC output signal.

The time for application of the above described direct current is 1 second to 5 seconds (for example, 3 seconds). By setting the adjustment time of the timer 10*c* at, for example, 3 seconds, the voltage supplied to the discharge lamp 4 can be changed from direct current into alternating current.

When the above described changeover signal is delivered to the full bridge driver circuit 11, the full bridge driver circuit 11 turns on the switching devices Q2, Q5 and the switching devices Q4, Q5 in alternation, such that the full bridge circuit 2 produces rectangular alternating waves with the above described frequency and applies a rectangular AC voltage to the discharge lamp 4. The frequency of the AC voltage with rectangular waves is 60 Hz to 1000 Hz (for example, 200 Hz).

In this way, the discharge lamp 4 passes into alternating current operation and reaches a steady operating state. The time starting from the arc discharge to the transition into steady-state operation is 10 seconds to 60 seconds (for example, 45 seconds).

During the interval of the above described direct current operation, instead of using a timer, the full bridge circuit 2 can be subjected to alternating current operation when the voltage applied to the terminal Vin for determining the voltage of the control circuit 10 exceeds a given voltage, for example, 25 V.

If, in the above described embodiment, the frequency of the AC voltage which is supplied to the discharge lamp 4 in a glow discharge is fixed higher than that of the AC voltage which is supplied during steady-state operation, the interval during which the glow discharge continues can be shortened even if during cathode operation of the electrode (with a small amount of adhesion of the mercury) the discharge is started and even if in this way a glow discharge forms. Thus, the formation time of the glow discharge can be shortened even more. The upper limit of the frequency of the AC voltage which is supplied in the glow discharge to the discharge lamp 4 is roughly 2 kHz.

In the situation in which depending on the positional relationship of the lamp to the reflector, the cooling condition and the like, the electrode having a large amount of mercury adhered during the cooling process of the lamp to almost room temperature (after the lamp is turned off) is always the same as was described above. Only then can the high voltage pulse for starting be produced, i.e., when the polarity of the AC voltage during starting of the electrode (with a large amount of adhesion of mercury) is negative.

In the situation in the above described embodiment when the state of the discharge lamp returns to a non-conductive state or to a glow discharge during direct current operation after the transition into an arc discharge has taken place once, the AC voltage can be applied again to the discharge lamp and the starting process repeated.

In this way, a technique results against the situation in which, after the transition into a direct current operation, the state of the discharge lamp due to the insufficient amount of adhesion leads again to a glow discharge or to lamp extinction. Although, there is also a situation in which for the half period of the alternating current in which the electrode with a small amount of mercury adhesion works as a cathode, depending on the manner of adhesion of the mercury, a transition into the arc discharge takes place.

In the situation, in which the state of the discharge lamp has passed once into an arc discharge and after the transition into direct current operation has returned to a glow discharge, before or after the application of the voltage with a polarity opposite the polarity in direct current operation to the discharge lamp, lamp extinction occurs when the glow discharge occurs when the state of the discharge lamp is returned again to an alternating current operation.

Furthermore, after re-ignition, a transition into an arc discharge occurs in which the electrode with a large amount of adhesion of the mercury is the cathode, and the electrode passes again into direct current operation. In this way, the time of the glow discharge can be reduced to a minimum.

Furthermore, in the situation in which the state of the discharge lamp passes once into an arc discharge and after the transition into direct current operation leads to lamp extinction, it is returned again to alternating current operation and a restart process is carried out. The reason for carrying out the restart process again by alternating current operation is the same reason as for carrying out the initial starting by alternating current operation.

Figure 2:
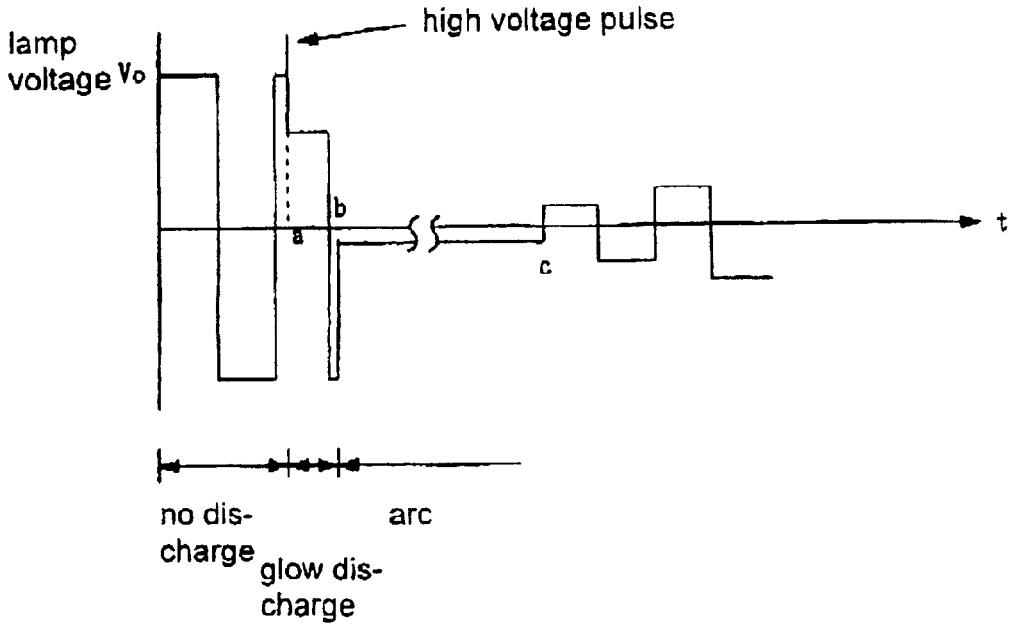
FIG. 2 shows a schematic of the lamp voltage waveform example (1) during starting of the lamp by a device of the invention for operating the discharge lamp.

FIG. 2 shows a lamp voltage waveform example [1] during lamp starting by the device for operation of discharge lamp in this embodiment. FIG. 2 shows the situation in which a high voltage pulse has formed and a glow discharge has occurred when the electrode with a small amount of mercury adhesion has a negative polarity. When a glow discharge forms, once before or after inverting the polarity, lamp extinction occurs once, and furthermore re-ignition of the discharge with reversed polarity takes place. The discharge formed by this re-ignition immediately passes into an arc discharge because the electrode with a large amount of mercury adhering is the cathode.

The control circuit 10 in this embodiment determines the reduction of the lamp voltage, as was described above, fixes the polarity during the interval from b to c and at c again carries out a transition into operation with alternating current. Afterwards, the discharge lamp 4 continues AC operation until a steady state is reached.

As is evident from this example, the formation time of the glow discharge when the discharge lamp starts is shortened to less than that or equal to the half period of the alternating current by the device of the invention for operating a discharge lamp. Sputtering of the electrode by the glow discharge is suppressed and an advantageous light flux maintenance characteristic is achieved.

Figure 3:
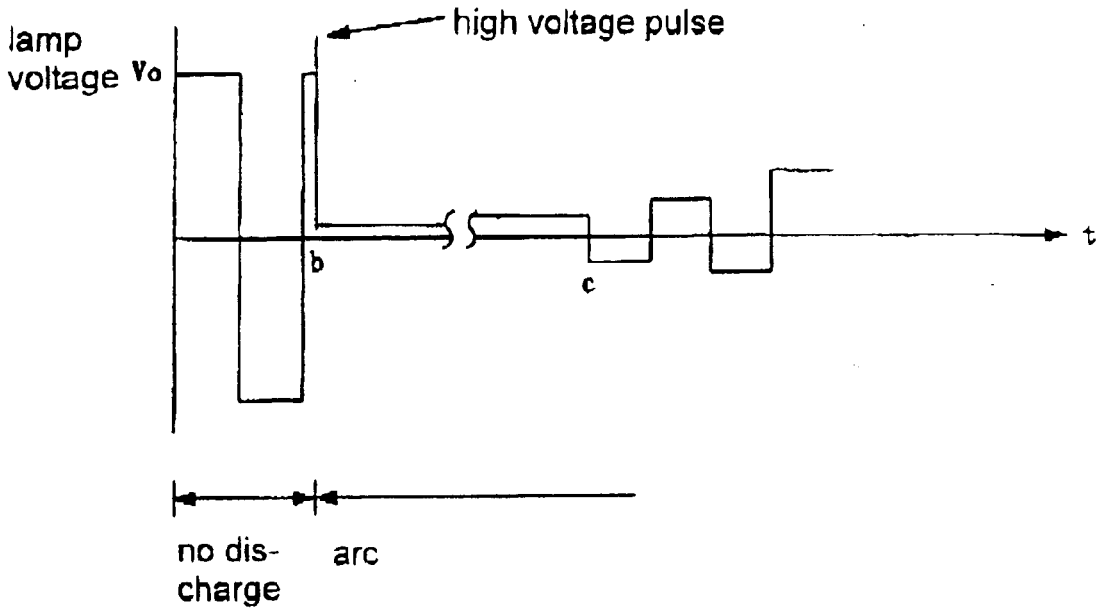
FIG. 3 shows a schematic of the lamp voltage waveform example (2) during starting of the lamp by a device of the invention for operating the discharge lamp.

FIG. 3 shows a lamp voltage waveform example [2] during lamp starting by the device for operation of discharge lamp in this embodiment. FIG. 3 illustrates the situation in which a high voltage pulse has formed and at b an arc discharge has rapidly occurred when the electrode with a large amount of mercury adhesion has a negative polarity. The control circuit 10, in this embodiment, determines the reduction of the lamp voltage, carries out direct current operation during the interval from b to c, at c carries out the transition into alternating current operation and afterwards reaches steady-state operation.

When starting the discharge, the electrode with a large amount of adhesion of mercury has a negative polarity, as in this example, in practice a glow discharge does not occur, and it can be maintained that there is passage through an ideal starting process.

Figure 4:
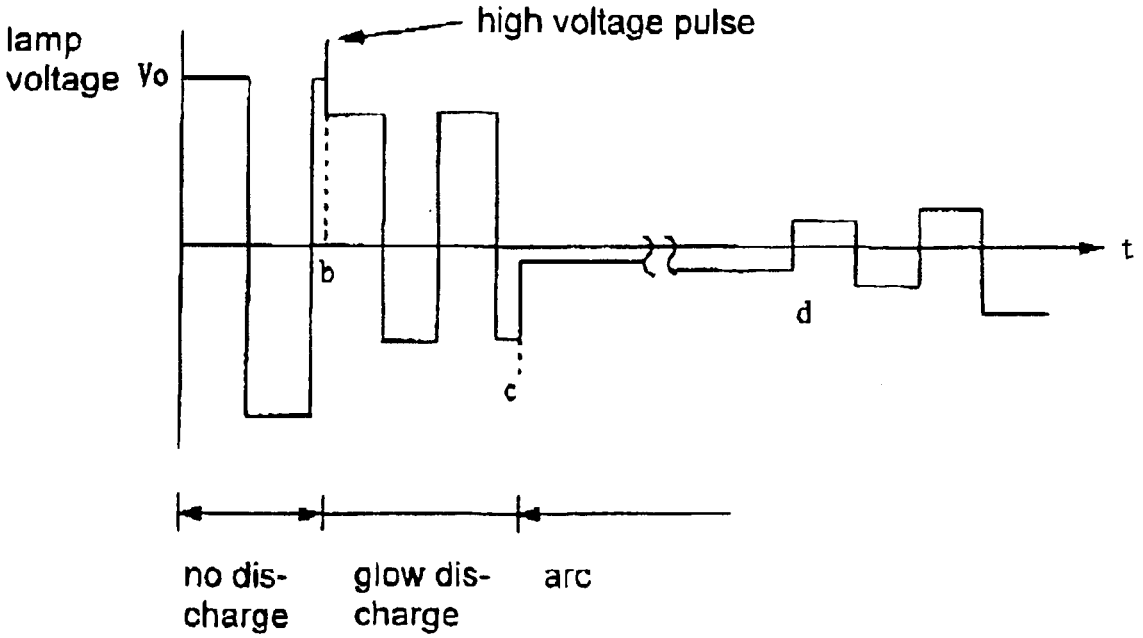
FIG. 4 shows a schematic of the lamp voltage waveform example (3) during starting of the lamp by a device of the invention for operating the discharge lamp.

FIG. 4 shows a lamp voltage waveform example [3] for lamp starting by the device for operating the discharge lamp in this embodiment. FIG. 4 shows the situation in which by a high voltage pulse which has formed at b a glow discharge occurs and that after the next inversion of polarity the glow discharge was still maintained, even if the voltage is lower than in the first glow discharge.

Since the voltage is, for example, at least 50 V in a glow discharge after the polarity inversion, this is the situation in which the control circuit 10 of this embodiment has continued alternating current operation and after alternating current operation with a few periods a transition into an arc discharge has taken place at c.

The control circuit 10 determines the reduction in the voltage in the transition into the arc discharge, carries out the transition into direct current operation and after a given time has passed, carries out a transition into alternating current operation at d.

This operation arises in the situation in which essentially the same amounts of mercury are adhering to the two electrodes of the discharge lamp, i.e., the mercury does adhere to the two electrodes. However, for the transition into an arc discharge immediately after ignition, the amount of mercury adhesion is low. After maintaining the glow discharge with a few periods a transition to an arc discharge takes place at the polarity at which the electrode with a temperature which has increased more rapidly has become the cathode and direct current operation is fixed with this polarity.

In the case as shown in FIG. 4, the temperature of the electrode which becomes the cathode at the lower polarity increases more rapidly. At c there is a transition into an arc discharge at this polarity. This difference between the rates of temperature increase of the electrodes occurs as the difference between the glow discharge voltages of the two polarities, as is shown in FIG. 4.

However, in such a situation, since the duration of the glow discharge is shortened more than when starting by the direct current with the upper polarity as shown in FIG. 4, in which for the individual lamps it is not fixed which electrode has a higher rate of temperature increase, the starting process by the device of the invention for operating a discharge lamp is efficient, since in this regard the sputtering of the electrode as a result of the glow discharge is reduced.

Figure 5:
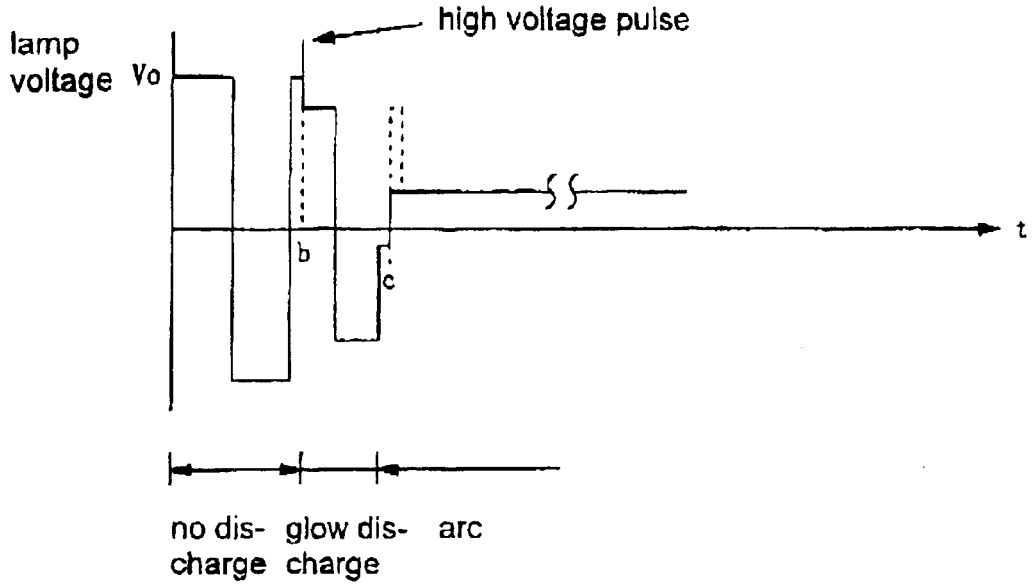
FIG. 5 shows a schematic of the lamp voltage waveform example (4) during starting of the lamp by a device of the invention for operating the discharge lamp.

FIG. 5 shows a lamp voltage waveform example [4] for lamp starting by the device for operating the discharge lamp in this embodiment. FIG. 5 shows a case in which a glow discharge has occurred by the high voltage pulse which has formed at b, after the next inversion of polarity the glow discharge was still maintained even if the voltage is lower than in the first glow discharge, and after polarity inversion at c immediately before the next polarity inversion a transition into an arc discharge has taken place.

The control circuit 10 determines the reduction of the voltage in the transition into an arc discharge and carries out a transition into direct current operation. However, since immediately before polarity inversion the transition into an arc discharge has taken place, the fixing to a DC voltage with a polarity which differs from the polarity at which the transition into the arc discharge took place is carried out by control delay. In this operation, no problems arise even if the arc discharge is maintained unchanged.

Furthermore, there is the situation in which, after the polarity inversion and fixing to the DC voltage, a return to a glow discharge takes place, as is shown using the broken lines in FIG. 5. In this situation, the lamp voltage rises and the control circuit 10 tries to change to alternating current operation, but since a direct transition into the arc discharge takes place, the polarity of the DC voltage is fixed at the polarity at this instant.

Figure 6:
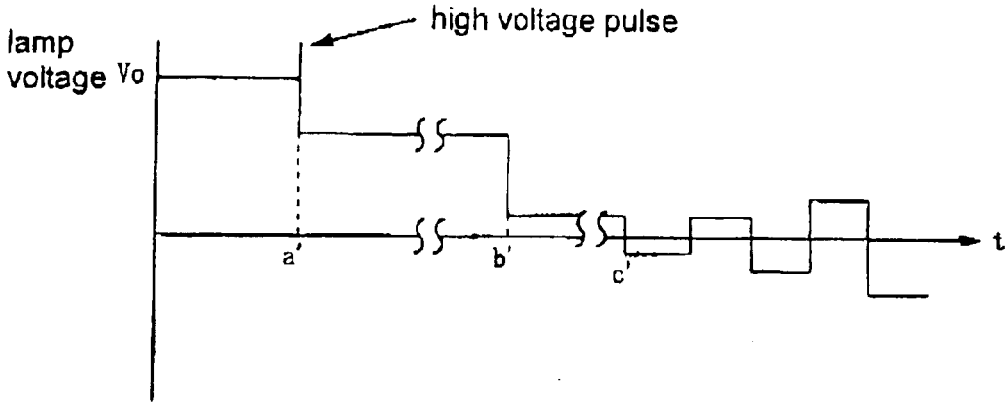
Fig. 6 (Prior Art)
FIG. 6 shows a schematic of a voltage waveform example in the case of starting a discharge lamp by a conventional DC voltage.

FIG. 6 shows the voltage waveform in the case of starting of the discharge lamp by a DC voltage by the prior art. That is, FIG. 6 illustrates the situation in which the polarity of the DC voltage of the electrode with a small amount of mercury adhering is negative, a high voltage pulse forms and a glow discharge occurs for a, as is identical to the case shown in FIG. 2. Afterwards, however, the glow discharge continues over an interval of ten and a few ms, i.e. from a' to b', since the polarity is not inverted. The glow discharge which prevails over such a long time sputters the electrode and reduces the light flux.

As was described above, in the discharge lamp of the invention the glow discharge when the lamp starts can be reduced to a relatively short time and the blackening of the lamp by sputtering can be reduced. Therefore the light flux maintenance characteristic can be improved. In particular, using a high pressure discharge lamp with greater than or equal to 0.15 mg/mm$^3$ mercury added, in a projector device of the projection type, in which the mercury adhering to the two electrodes is not the same (as a result of cooling, deviation of the electrode position and the like), the formation time of the glow discharge can be effectively shortened.

What is claimed is:

1. A device for operating a high pressure discharge lamp comprising:

a high pressure discharge lamp having a silica glass discharge vessel filled with at least 0.15 mg/mm$^3$ of mercury and in which a pair of opposed electrodes are disposed, and a feed device which supplies a discharge current to the discharge lamp, wherein the feed device includes a means for applying an AC voltage to the discharge lamp during a glow discharge when lamp operation is initiated, to apply a DC voltage for a pre-selected time to the discharge lamp after a transition from the glow discharge into an arc discharge, and after the pre-selected time has expired, to apply an AC voltage to the discharge lamp.

2. A device for operating a high pressure discharge lamp as claimed in claim 1, wherein the feed device is adapted to set a frequency of the AC voltage which is applied to the discharge lamp during the glow discharge higher than a frequency of the AC voltage which is applied during steady-state operation of the discharge lamp.

3. A device for operating a high pressure discharge lamp as claimed in claim 1, wherein the feed device provides a high voltage pulse for initiating the discharge lamp only at a certain polarity of the AC voltage.

* * * * *